US008621679B1

(12) United States Patent
Donikian

(10) Patent No.: US 8,621,679 B1
(45) Date of Patent: Jan. 7, 2014

(54) MOTORIZED BACK SCRUBBER DEVICE

(76) Inventor: Francisco A. Diaz Donikian, Miami, FL (US)

( * ) Notice: Subject to any disclaimer, the term of this patent is extended or adjusted under 35 U.S.C. 154(b) by 667 days.

(21) Appl. No.: 12/841,939

(22) Filed: Jul. 22, 2010

(51) Int. Cl.
*A47K 7/02* (2006.01)

(52) U.S. Cl.
USPC ..... 4/606; 15/21.1

(58) Field of Classification Search
USPC ..... 4/606; 15/88.3
See application file for complete search history.

(56) References Cited

U.S. PATENT DOCUMENTS

| | | | | | |
|---|---|---|---|---|---|
| 398,514 | A | * | 2/1889 | Kitchen | 4/606 |
| 1,587,353 | A | * | 6/1926 | Pfeufer | 4/606 |
| 4,008,503 | A | * | 2/1977 | Tharp | 15/88.3 |
| 4,047,259 | A | | 9/1977 | Lotis | |
| 4,356,583 | A | * | 11/1982 | Wallasch et al. | 15/88.4 |
| 4,704,759 | A | | 11/1987 | Mesa | |
| 4,943,018 | A | | 7/1990 | Glaser et al. | |
| 5,228,165 | A | | 7/1993 | Westberry et al. | |
| 5,345,640 | A | * | 9/1994 | Goss | 15/88.2 |
| D351,947 | S | | 11/1994 | Fitzgerald | |
| 5,517,705 | A | * | 5/1996 | Jackson | 4/606 |
| 5,561,869 | A | * | 10/1996 | Sarel | 4/606 |
| D409,337 | S | | 5/1999 | Johnson, Jr. | |
| 6,174,296 | B1 | * | 1/2001 | Wang | 601/114 |
| D450,158 | S | | 11/2001 | Swann | |
| 7,063,172 | B1 | * | 6/2006 | Marentette | 173/184 |
| 7,578,021 | B1 | * | 8/2009 | Figueroa | 15/104.92 |
| 2006/0107473 | A1 | | 5/2006 | Torres | |

* cited by examiner

*Primary Examiner* — Gregory Huson
*Assistant Examiner* — Lauren Heitzer

(57) ABSTRACT

A motorized back scrubber device for installing in a shower featuring two parallel poles for securing to the shower wall, a motor housing slidably disposed on the first pole; a brush motor and track motor disposed in the motor housing; an elongated brush that engages the brush motor, wherein the brush motor functions to rotate the brush in a clockwise or a counterclockwise direction and the track motor functions to move the motor housing up and down on the pole; a drive lever with control panel extending outwardly from the motor housing, the control panel functions to control speed of rotation and direction of rotation of the brush motor and functions to control direction of the track motor; and a soap dispenser operatively connected to the control panel to pump soap to the brush.

1 Claim, 4 Drawing Sheets

MOTORIZED BACK SCRUBBER DEVICE

FIELD OF THE INVENTION

The present invention is directed to shower accessories, more particularly to a motor-driven back scrubbing device for cleaning a user's back.

BACKGROUND OF THE INVENTION

Cleaning one's back can be difficult and awkward if one uses a hand-held scrub brush. The present invention features a motorized back scrubber device for installing in a shower. The motorized back scrubber device of the present invention enables a user to easily scrub his/her back. The motorized back scrubber device may provide for a more efficient and faster cleaning as compared to a hand-held brush.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a motorized back scrubber device for installing in a shower. The device comprises a sliding track comprising a first pole and a second pole, each pole having a top end and a bottom end, the poles are positioned generally parallel to each other, wherein the sliding track is secured to a wall of the shower via a second securing means; a motor housing slidably disposed on the first pole; a brush motor disposed in the motor housing; and an elongated brush comprising an axle having a first end that engages the brush motor in the motor housing and a second end that extends toward the second pole, wherein the brush motor functions to rotate the brush in a clockwise or a counterclockwise direction. The device further comprises a track motor disposed in the motor housing, wherein the track motor functions to move the motor housing with the brush upwardly and downwardly on the first pole; a control panel disposed on a drive lever, the drive lever extends outwardly from the motor housing, wherein the control panel is operatively connected to the brush motor and to the track motor, the control panel functions to control speed of rotation and direction of rotation of the brush motor and functions to control direction of the track motor; and a soap dispenser comprising a soap reservoir for storing soap, a pump component, and a soap hose fluidly connected to the soap reservoir and the brush, wherein the pump component is operatively connected to the control panel which functions to control pumping of the soap from the reservoir to the brush via the soap hose.

In some embodiments, the device further comprises an upper transverse connecting the first pole and the second pole near the top ends of the respective poles. In some embodiments, the device further comprises a lower transverse connecting the first pole and the second pole near the bottom ends of the respective poles. In some embodiments, the device further comprises a rubber stopper disposed on each of the top end of the first pole and the top end of the second pole.

In some embodiments, the second securing means is a suction cup or a combination wall mat and suction cup. In some embodiments, the bottom ends of the poles each extend to a floor area of the shower, wherein the bottom ends of the poles are secured to the floor of the shower via a first securing means. In some embodiments, the first securing means is a suction cup or a combination wall mat and suction cup.

In some embodiments, the brush is constructed from a material comprising bristles, mesh, cloth, artificial sponge, natural sponge, or a combination. In some embodiments, the device further comprises a first sleeve bearing slidably disposed on the first pole above the motor housing. In some embodiments, the device further comprises a second sleeve bearing slidably disposed on the second pole. In some embodiments, the device further comprises a first spring disposed between the motor housing and the top end of the first pole. In some embodiments, the brush motor and the track motor are each operatively connected to a battery. In some embodiments, the device further comprises a shield surrounding a portion of the brush to help prevent soap from splashing on the wall of the shower.

DESCRIPTION OF PREFERRED EMBODIMENTS

Referring now to FIG. 1-4, the present invention features a motorized back scrubber device 100 for installing in a shower. The motorized back scrubber device 100 of the present invention enables a user to easily scrub his/her back. The motorized back scrubber device 100 may provide for a more efficient and faster cleaning as compared to a hand-held brush. The device 100 of the present invention is not limited to use on a user's back. For example, the device 100 may be used on a user's head, neck, shoulders, chest, abdomen/stomach, arms, legs, etc. The device is easy for any individual to use, such as children, adults, and elderly individuals. The device 100 can be used when standing or even when a user is seated.

Figure 1:
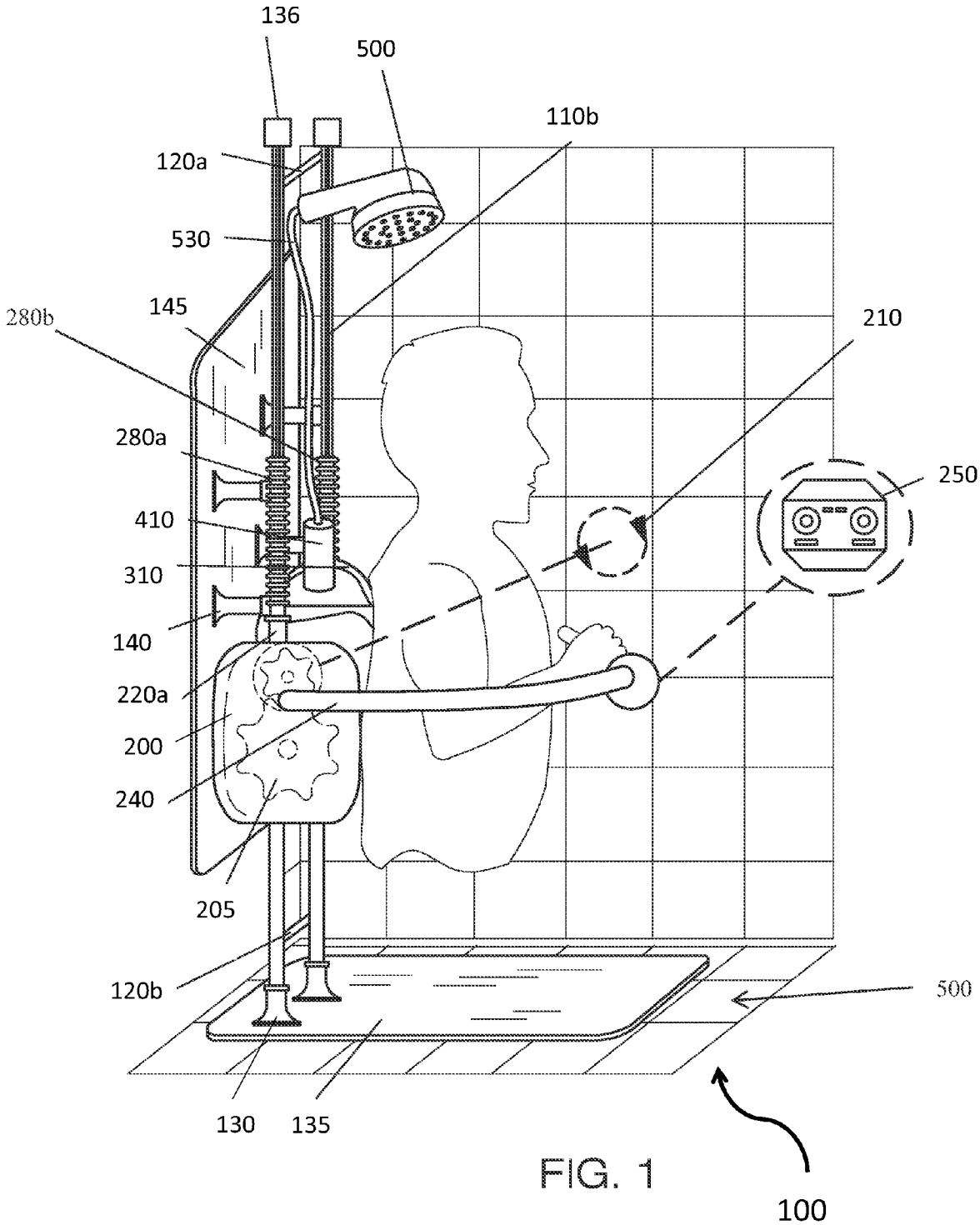
FIG. 1 is a side perspective view of the motorized back scrubber device of the present invention as installed in a shower.
Figure 2:
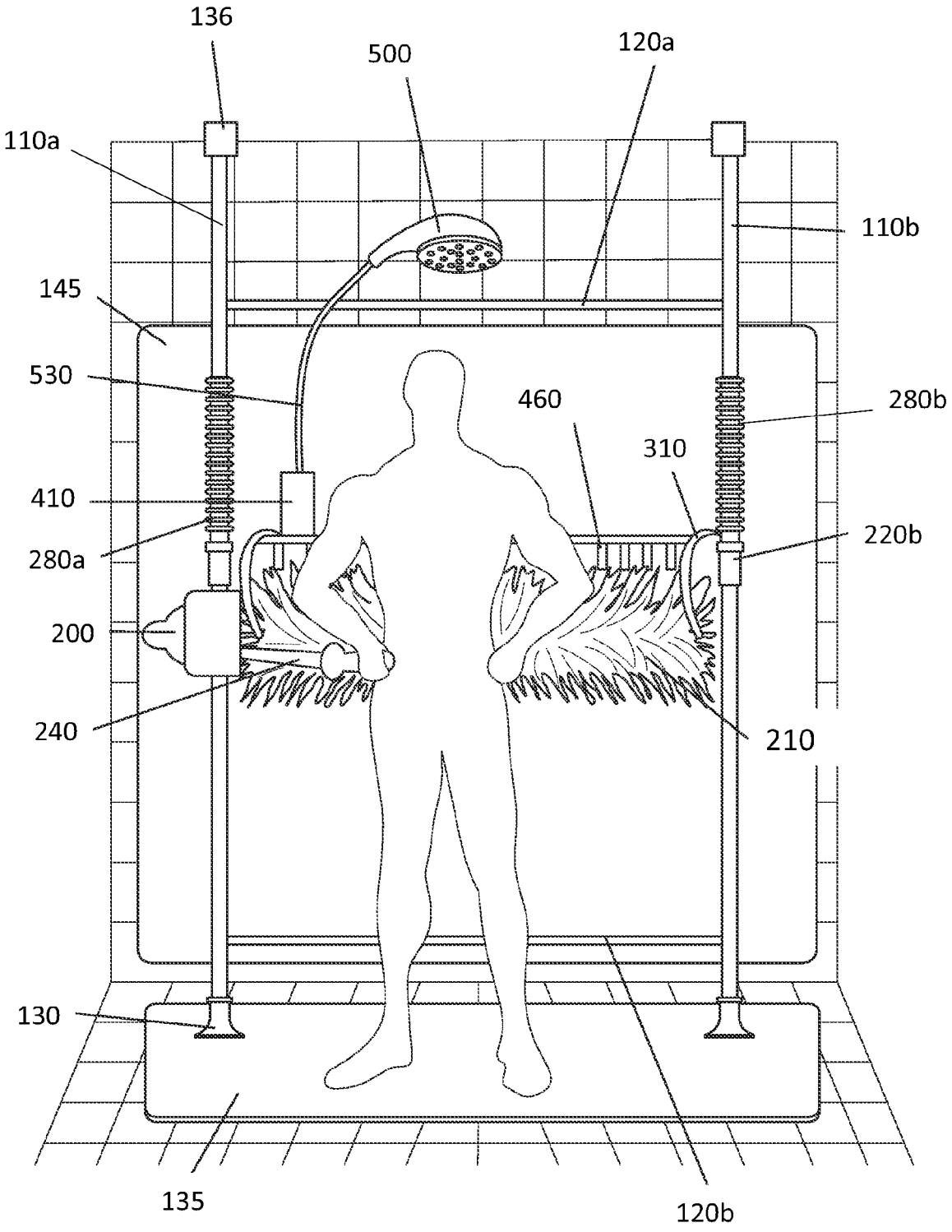
FIG. 2 is a front perspective view of the motorized back scrubber device of the present invention as installed in a shower.
Figure 3:
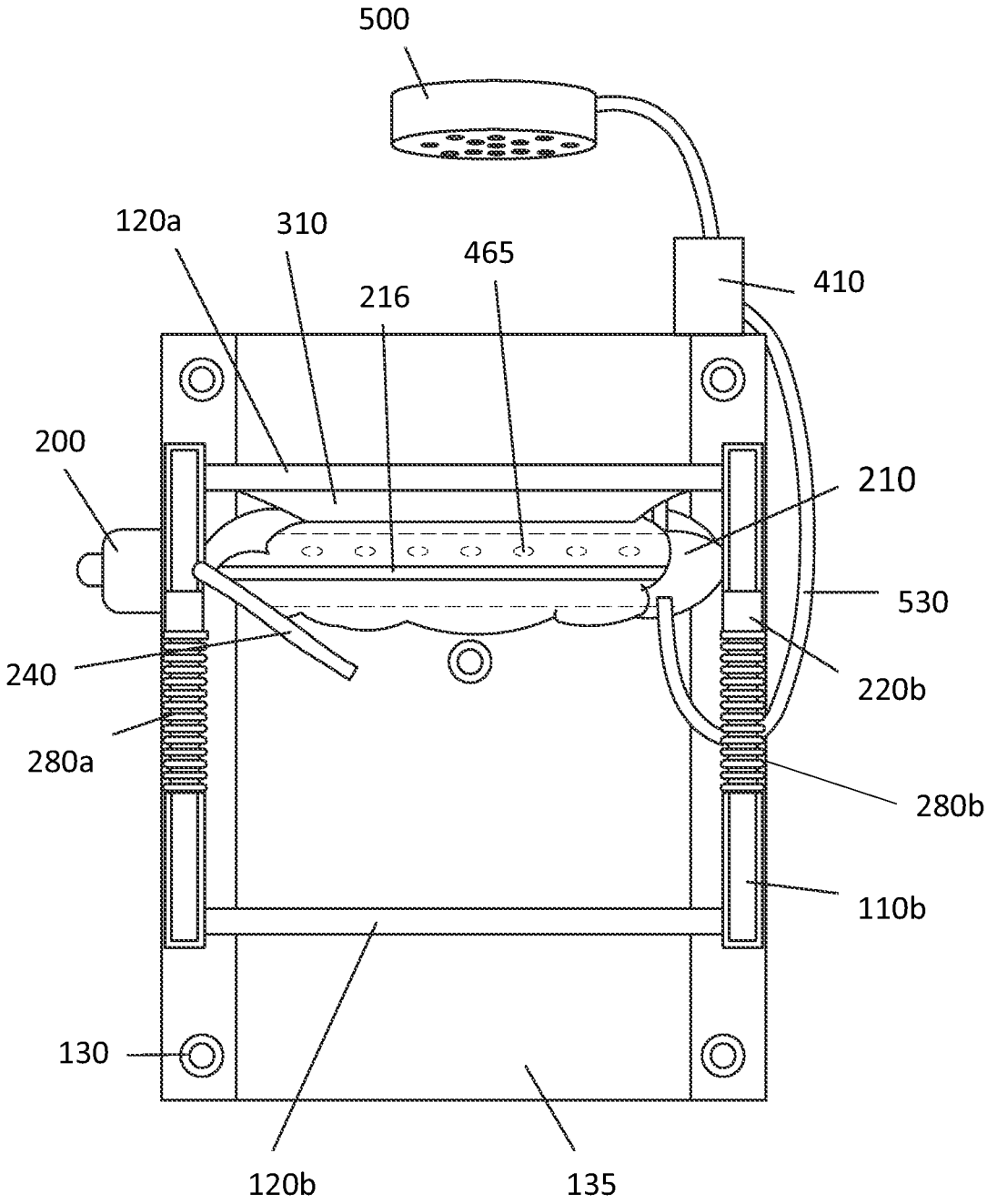
FIG. 3 is a schematic diagram of components of the motorized back scrubber device of the present invention.

The motorized back scrubber device 100 comprises a sliding track that can be attached to a shower wall. As shown in FIG. 1 and FIG. 2, the sliding track comprises two poles/pillars, for example a first pole 110*a* and a second pole 110*b*, each pole 110 having a top end and a bottom end. The poles 110 are positioned generally parallel to each other. In some embodiments, an upper transverse 120*a* connects the first pole 110*a* and the second pole 110*b* near the top ends of the poles 110, and a lower transverse 120*b* connects the first pole 110*a* and the second pole 110*b* near the bottom ends of the poles 110.

In some embodiments, bottom ends of the poles 110 extend to the floor 500 of the shower. The bottom ends of the poles 110 may be secured to the floor of the shower via a first securing means. For example, in some embodiments, the first securing means includes one or more first suction cups 130 and/or a floor mat 135 (e.g., rubber mat). In some embodiments, rubber stoppers 136 are disposed on the top ends of the poles 110. The sliding track (e.g., poles 110) may be secured to the shower wall via a second securing means. For example, the second securing means may comprise one or more second suction cups 140 and/or a wall mat 145 (e.g., rubber mat).

As shown in FIG. 1 and FIG. 2, a motor housing 200 is slidably disposed on the first pole 110*a*. A brush motor 205 is disposed in the motor housing 200. The motor housing 200 helps protect the brush motor 205 (or other components) from moisture.

The device 100 of the present invention further comprises a roller brush 210. The roller brush 210 may be generally cylindrical or irregular in shape. The brush 210 may be constructed from a variety of materials and may be tailor made for a user (e.g., soft, abrasive, etc.). The brush 210 has an axle 216 with a first end and a second end. The first end of the axle 216 of the brush 210 engages the brush motor 205 in the motor housing 200 (the motor housing 200 is slidably disposed on the first pole 110*a*). Generally, the brush 210 is positioned perpendicularly to the first pole 110*a*, although the brush 210 is not limited to this position. In some embodiments, the second end of the axle 216 of the brush 210 does not engage anything (e.g., the second pole 110*b*). In some embodiments, the second end of the axle 216 engages a sliding component slidably disposed on the second pole 110*b*. The roller brush 210 can be adjusted according to the user's height. For example, the user can manipulate the range of the roller brush's position via switches of the control panel (on the drive lever 240).

The brush 210 can rotate either counterclockwise or clockwise, wherein the user can choose the direction in which the brush 210 rotates. The brush 210 is operatively connected to the brush motor 205, wherein the brush motor 205 functions to rotate the brush 210 in either the counterclockwise or clockwise direction. In some embodiments, the brush motor 205 functions to move the brush 210 in alternative directions, for example in a side-to-side direction or an irregular direction.

The brush 210 can be used to massage and brush the user's back, neck, legs, shoulders, and/or the like. In some embodiments, the brush 210 helps improve blood flow. The brush 210 may provide a relaxing massage.

The brush motor 205 is operatively connected to a control panel 250. The control panel 250 functions to control the brush motor 205, for example the speed at which the brush motor 205 rotates the brush 210 and/or the direction (e.g., clockwise, counterclockwise) in which the brush motor 205 rotates the brush 210. Control panels and components thereof are well known to one of ordinary skill in the art. For example, in some embodiments, the control panel 250 allows a user to select a low speed, a medium speed, and a high speed and/or allows a user to turn the brush motor 250 on and off. In some embodiments, the control panel 250 is disposed on a drive lever 240 that extends outwardly from the motor housing 200. The drive lever 240 allows a user to manipulate the brush 210 (e.g., speed, direction) while showering with his/her back to the brush 210.

In some embodiments, a track motor is disposed in the motor housing 200, wherein the track motor functions to move the motor housing 200 and brush 210 upwardly and downwardly with respect to the poles 110. Motors that function to move an object up and down a cylindrical pole are well known to one of ordinary skill in the art. The motor housing 200 can be slid upwardly and downwardly on the first pole 110*a* (via the track motor) so that a user can find a position that suits him/her best. When the user finds an ideal position for the motor housing 200, he/she can deactivate the track motor.

The track motor is operatively connected to the control panel 250, which functions to control the movement of the motor housing 200 and brush 210 via the track motor.

In some embodiments, a first sleeve bearing 220*a* (e.g., plastic sleeve bearing) is slidably disposed on the first pole 110*a*, for example above the motor housing 200. In some embodiments, a second sleeve bearing 220*b* is slidably disposed on the second pole 110*b*. The first poles 110*a* and second poles 110*b* may be roller tracks (see FIG. 4).

In some embodiments, a first spring 280*a* is disposed between the motor housing 200 (or the first sleeve bearing 220*a*) and the top end of the first pole 110*a* (e.g., a rubber stopper 136 on the top end of the first pole 110*a*). In some embodiments, a second spring 280*b* is disposed between the second sleeve bearing 220*b* and the top end of the second pole 110*b* (e.g., a rubber stopper 136). The springs 280 can help prevent the motor housing 200 and brush 210 from moving too far up the poles 110. In some embodiments, the first spring 210 may lightly resist the movement (e.g., vertical) of the motor housing 220 upwardly on the pole 110*a*, which may make for smoother movements, e.g., when the user wants to wash any part of his/her body repetitively.

The brush motor 205 and track motor are operatively connected to a power source (e.g., battery). In some embodiments, the power source is a rechargeable battery. In some embodiments, the control panel 250 is operatively connected to the power source.

The back scrubber device 100 of the present invention further comprises a soap dispenser comprising a soap reservoir 410 for storing soap (e.g., liquid soap) a pump component, and a soap hose fluidly connected to the soap reservoir 410 and the brush 210 (e.g., the axle 216, pores in the axle 216, etc). The pump component may be operatively connected to the control panel 250, wherein the control panel 250 can manipulate the pumping of the soap. The soap reservoir 410 may be disposed on a frame 460 (see FIG. 2). In some embodiments, the soap dispenser functions via capillary action or via the pump component. For example, the brush 210 may comprise a plurality of pores, which are fluidly connected to the soap reservoir 410 via the soap hose. When a portion of liquid soap of bath gel is released from the soap reservoir 410 (e.g., via a the control panel 250), the soap/gel goes through the soap hose to the pores 465 in the brush 210 and onto the user's skin. In some embodiments, there is no water hose 530. In some embodiments, the device comprises a water hose 530. In some embodiments, the water hose 530 runs from the showerhead 500 through the reservoir 410.

Figure 4:
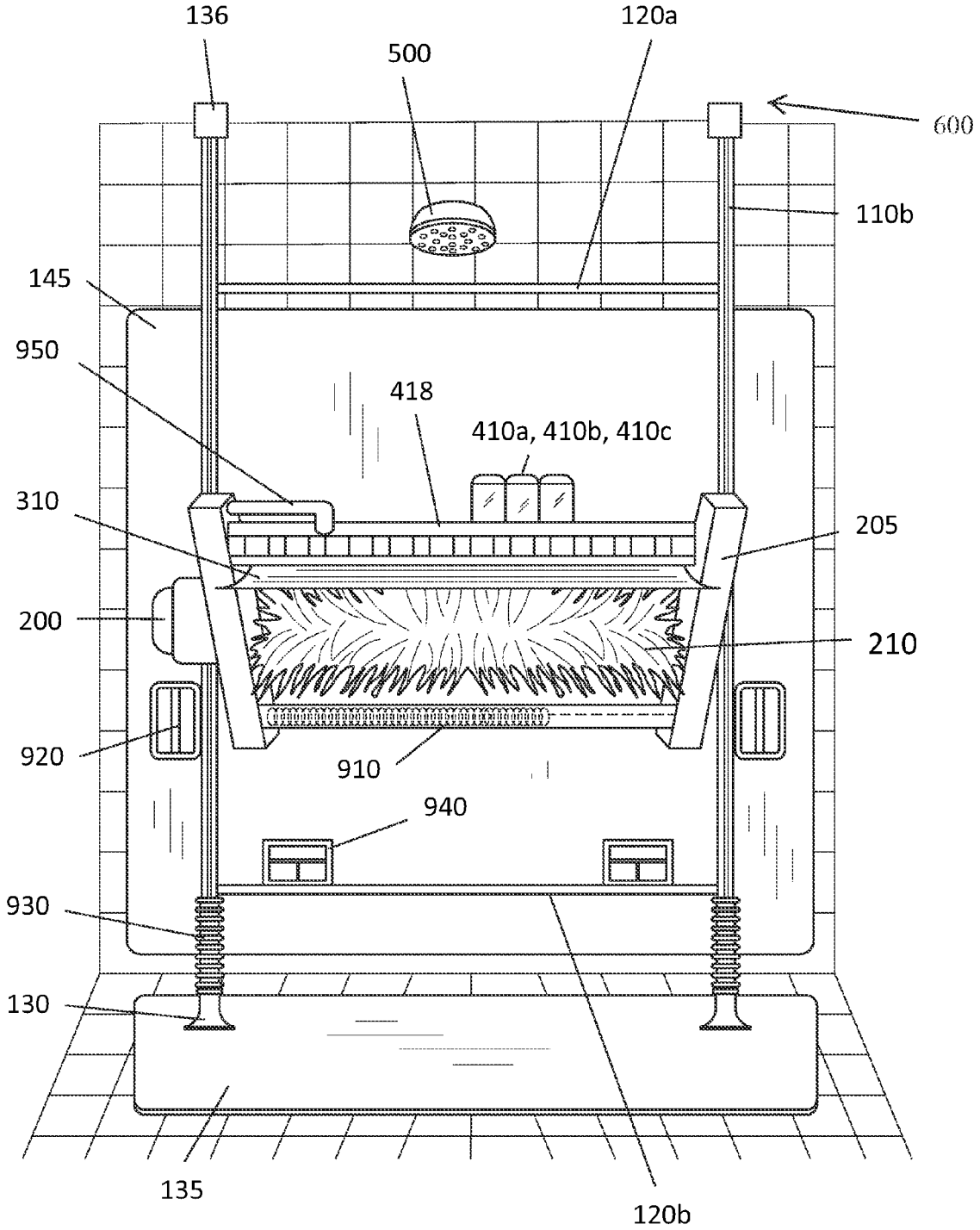
FIG. 4 is a front view of an alternative embodiment of the device of the present invention.

In some embodiments, the soap dispenser comprises multiple reservoirs 410, as shown in FIG. 4. For example, the soap dispenser may comprise a first reservoir 410*a*, a second reservoir 410*b*, and a third reservoir 410*c* (or more than three reservoirs). In some embodiments, the soap dispenser is operatively connected to a self-soaping device 418.

In some embodiments, a shield 310 (e.g., like a car fender with splash guard) surrounds a portion of the brush 210, for example the shield 310 is positioned above the brush 210. The shield 310 can help prevent the soap from splashing the walls of the shower.

The brush 210 may be constructed in a variety of styles and from a variety of materials. In some embodiments, the brush 210 is constructed from a material comprising bristles, mesh, cloth, artificial sponge or natural sponge, the like, or a combination (according to the user's preference). In some embodiments, each brush 210 is covered with a material (e.g., bristles, mesh, cloth, etc.) and further with another product (e.g., cleansing product). In some embodiments, the brush

210 is installed on a sturdy roller frame (e.g., 5-wire ring cage) welded to hold the core and stop it from slipping.

The device 100 of the present invention can be easily assembled and installed. The device 100 may be constructed in a size (or sizes) to accommodate standard showers or non-standard showers.

The device 100 of the present invention can allow a user to cleanse any portion of the body (front and back) with a simple action to move the brush 210 via the control panel 250 (on the drive lever 240), for example speed, direction, and/or up and down on the poles 110. A user can also choose the kind of brush 210 (e.g., cleansing surface) as desired.

The height of the back scrubber can be adjusted. For example, two pinions are installed at each pole (left and right) that will travel up and down on both rack gears located behind the poles (similar to a track). The movement of these pinions is powered by the main electric motor and controlled by the control panel. The height range of the roller brush can be adjusted as well. Each pinion can be released from the rack gear through a release clutch located at the drive lever, similar to a clutch lever of a bike. Once the range of height is adjusted on the roller brush, the user can apply manually continuous upward/downward repetitive movements on different parts of his/her body. All movements will be smooth due to the function of the sleeve bearings and springs installed at both poles.

The brush may be constructed in a variety of styles and from a variety of materials (bristles, mesh, cloth, artificial sponge, or natural sponge) according to the user's preference. In some embodiments, the roller brush is a cylinder. Its surface may have a material known as double contact. Cleansing surfaces of the cylinder that the user chooses (bristles, mesh, cloth, artificial sponge, or natural sponge) may have in its posterior part the double contact material to stick to the cylinder. To put the surface of the user's preference to be more abrasive or less abrasive, the user just has to attach the chosen surface on the surface of the cylinder. The brush may be installed on a sturdy roller frame (e.g., 5-wire ring cage) welded to hold the core and stop it from slipping. The roller brush may be used for cleaning multiple different body parts, not just the user's back. For example, the user may clean his/her abdomen, chest, shoulders, etc. In some embodiments, a duplicate control panel to drive the back scrubber with the other adopted positions may be installed. In some embodiments, another handle may be installed to facilitate upwards/downwards movement. In some embodiments, the roller brush may be linked to restriction springs, which push the roller brush forward and facilitate its travel.

In some embodiments, mechanical extensions are used in the device of the present invention, such as those used for blocking aisles (e.g., extendable aisle gates). Such extension devices are well known to one of ordinary skill in the art. The extensions may have lock and releasing features to fix or release it from the frame of the back scrubber.

In some embodiments, the device of the present invention further comprises grabbing handles 920. The grabbing handles may be disposed on each side of the frame, making them easily accessible. The grabbing handles may be particularly useful for elderly individuals.

In some embodiments, the device further comprises resting steps 940 to facilitate the cleaning of thighs, knees, femoral biceps, feet, and other parts of the body. The steps may be positioned on both sides of the lower crossbar 120*b*.

The device of the present invention may be adjusted vertically. The lower rubber tops of the poles have firm contact with the floor and the upper ones have contact with the ceiling 600. To establish an exact measurement for the adjusting poles, behind the poles there may be a set of bars with holes (like a flute) or dents. In some embodiments, the adjusting of the poles may be done with pins or a duty bar clamp. Final adjusting may be through threads 930 at the bottom of both poles until lower and upper rubber tops have solid contact with the floor and ceiling, respectively. The device may also be adjusted horizontally according to the size of the tub already existing in the home.

The drive lever may have a rotator knob to move the roller brush upwardly and downwardly continuously without uncomfortable gestures. For example, to push the roller brush down the user may just push down the drive lever very lightly.

In some embodiments, the device of the present invention has a reservoir for liquid soap and/or bath gel. The reservoir may function to hold multiple types of soaps and/or gels, for example the reservoir may have multiple compartments. The reservoir set may be installed above the anti-splash shield. The releasing of the soap or gel may be controlled with the control panel of the drive lever. A user can select a choice and a solenoid mechanism may move a bar with a hole below the bottom of each reservoir (e.g., a fixed amount of soap or gel). The present invention is not limited to a solenoid mechanism. The soap or gel may be dispensed to the surface of the roller brush.

The water hose may be optional. Instead, a user may wish to be seated and take a bath using the portable showerheads. In some embodiments, this type of portable showerhead may be included with the device of the present invention. A support may be disposed near the gel reservoir to grab the portable showerhead.

The device of the present invention allows movement of the roller brush in either the clockwise or counterclockwise direction, as the user wishes.

In some embodiments, the motor is operatively connected to a rechargeable battery (e.g., rechargeable heavy duty battery pack). The power may be used for purposes including but not limited to the motors rotation of the roller brush, the motor's movement of the roller brush upwardly and downwardly (with its splash guard, bath gel reservoir, pump, hose, solenoid mechanism, etc.), pumping bath gel from reservoir to surface of roller brush, and/or control panel functions.

In an alternative embodiment, the device may comprise many of the aforementioned components. However, in some embodiments, a spring 910 is located in a horizontal position installed in between both poles. The torque of this spring 910 allows the smooth movement outwardly and downward of the roller brush, even the repetitive action of the user to clean his/her body. The spring 910 may also help make the brush stay up initially. With a rectangular handle 920 installed, a user can apply either a forward or backward movement to the set conformed by the roller brush, motor, and splashing shield. The handle 920 may have a releasing lever to release a latch governed by a spring. Releasing that latch may allow a free forward/backward movement of the set (roller brush, motor, and splashing shield) or adjusting it in any desired position. To make it possible to adjust the set in any desired position, the latch may bite dents of the racks that will be inside of the horizontal sliding tracks. Also, the adjusting may be via a system called locks by segments. As the travel of this roller brush may not be uniform, the roller brush may be linked to restricting springs. These springs may push the roller brush forward and facilitate it to register the sinuosity and may conform to the body with less contact.

In the alternative embodiment, the vertical springs and the sleeve bearings are eliminated. Both embodiments discussed may have grabbing handles, resting steps, and thread devices to apply final adjusting. Both embodiments discussed may have restriction springs installed in the mechanism of the roller brush to facilitate uniform cleaning. As shown in FIG. 4, no water hose is present. Also shown in FIG. 5 is a control handle 950.

The following the disclosures of the following U.S. Patents are incorporated in their entirety by reference herein: U.S. Pat. No. 5,228,165; U.S. Pat. Application No. 2006/0107473; U.S. Pat. No. 5,345,640; U.S. Pat. No. 4,943,018; U.S. Pat. No. 4,704,759; U.S. Pat. No. 4,047,259; U.S. Pat. No. 5,561,869.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A motorized back scrubber system consisting of:

A. a shower consisting of a wall, a floor and a ceiling, a wall mat is disposed on the wall and a floor mat is disposed on the floor;

B. a motorize back scrubber device consisting of:

(a) a sliding track consisting of a first pole and a second pole, each pole consisting of a top end and a bottom end, the poles are positioned generally parallel to each other, wherein the sliding track is secured to the wall of the shower via a second securing means, wherein the second securing means is a suction cup that attaches to the wall mat;

wherein the bottom ends of the poles each extend to a floor area of the shower, wherein the bottom ends of the poles are secured to the floor of the shower via a first securing means, wherein the first securing means is a suction cup or a combination wall mat and suction cup;

wherein a top end of the first pole and a top end of the second pole consists of a rubber stopper disposed on each of the top end of the first pole and the top end of the second pole;

(b) a motor housing slidably disposed on the first pole;

(c) a brush motor disposed in the motor housing;

(d) an elongated brush consisting of an axle consisting of a first end that engages the brush motor in the motor housing and a second end that extends toward the second pole, wherein the brush motor functions to rotate the brush in a clockwise or a counterclockwise direction, the brush is perpendicularly disposed to the first and second pole;

(e) a track motor disposed in the motor housing, wherein the track motor functions to move the motor housing with the brush upwardly and downwardly on the first pole;

(f) a control panel disposed on a rigid drive lever, the drive lever extends outwardly from the motor housing, wherein the control panel is operatively connected to the brush motor and to the track motor, the control panel functions to control speed of rotation and direction of rotation of the brush motor and functions to control direction of the track motor;

(g) a soap dispenser consisting of a soap reservoir for storing soap, a pump component, and a soap hose fluidly connected to the soap reservoir and the brush, wherein the pump component is operatively connected to the control panel which functions to control pumping of the soap from the reservoir to the brush via the soap hose;

(h) a first spring disposed between the motor housing and the top end of the first pole, wherein the spring wraps around the first pole, a second spring disposed between the motor housing and the top end of the second pole, wherein the spring wraps around the second pole;

(i) a shield is horizontally disposed fully above the brush to help prevent soap from splashing on the wall of the shower; and (j) a lower cross bar connecting the first pole and the second pole near the bottom ends of the respective poles, wherein the lower cross bar consists of resting steps.

* * * * *